US007163161B2

(12) United States Patent
Horn

(10) Patent No.: US 7,163,161 B2
(45) Date of Patent: Jan. 16, 2007

(54) NOZZLE FOR THINNING OF PHOSPHINE

(76) Inventor: Franziskus Horn, Contraalmirante Fernandez Vial 10.652, Lo Barnechea, Santiago (CL)

( * ) Notice: Subject to any disclaimer, the term of this patent is extended or adjusted under 35 U.S.C. 154(b) by 188 days.

(21) Appl. No.: 10/118,814

(22) Filed: Apr. 9, 2002

(65) Prior Publication Data

US 2002/0148913 A1 Oct. 17, 2002

(30) Foreign Application Priority Data

Apr. 17, 2001 (DE) ..... 201 06 613 U

(51) Int. Cl.
*B05B 7/06* (2006.01)
*F23D 11/16* (2006.01)

(52) U.S. Cl. ..... 239/430; 239/432; 239/422; 239/9

(58) Field of Classification Search ..... 239/430, 239/432, 433, 290, 291, 296, 422, 543, 419.5, 239/9, 434.5
See application file for complete search history.

(56) References Cited

U.S. PATENT DOCUMENTS

| | | | | |
|---|---|---|---|---|
| 272,863 | A * | 2/1883 | Douglas | 239/417.3 |
| 3,371,618 | A * | 3/1968 | Chambers | 417/163 |
| 3,721,387 | A * | 3/1973 | Wilmot, Jr. | 239/416.4 |
| 4,095,748 | A * | 6/1978 | Ohtake et al. | 239/419.3 |
| 4,334,783 | A | 6/1982 | Suzaka | |
| 4,592,509 | A * | 6/1986 | Moss | 239/424 |
| 4,721,562 | A | 1/1988 | Barnscheidt et al. | |
| 4,915,300 | A * | 4/1990 | Ryan | 239/9 |
| 5,014,916 | A * | 5/1991 | Trapani et al. | 239/85 |
| 5,403,475 | A | 4/1995 | Allen | |
| 5,429,308 | A * | 7/1995 | Brown | 239/414 |
| 5,899,387 | A * | 5/1999 | Haruch | 239/296 |

FOREIGN PATENT DOCUMENTS

| | | | |
|---|---|---|---|
| DE | 1 256 200 | | 12/1961 |
| DE | 19534107 | A1 * | 3/1997 |
| EP | 0 981 960 | | 8/1999 |
| JP | 01038131 | A * | 2/1989 |
| WO | 95/26226 | | 10/1995 |

OTHER PUBLICATIONS

Philpott, G. "European Search Report", *European Patent Office*, 25.07.02.

* cited by examiner

*Primary Examiner*—Chen Wen Jiang
(74) *Attorney, Agent, or Firm*—Fish & Richardson P.C.

(57) ABSTRACT

The present invention relates to a nozzle for thinning of phosphine (chemical formula $PH_3$), which is consisting in a tube-like air-inducing, a ring-like mounted split (ring split) and/or in at least one lateral mounted little tube as $PH_3$-inducing (inducer), whereby the thickness of the split opening and/or of the opening of the little tube is maximum 1/25 of the diameter of the tube like air-inducing (inducer) and/or of the distance between the surface of an air guiding element and the inner side of the tube-like air-inducing (inducer) in the area of the $PH_3$-entrance.

6 Claims, 1 Drawing Sheet

NOZZLE FOR THINNING OF PHOSPHINE

Pursuant to 35 USC § 119, this application claims the benefit of German Patent Application No. 201 06 613.0 filed Apr. 17, 2001.

BACKGROUND OF THE INVENTION

The present invention relates to a nozzle for thinning of phosphine (chemical formula $PH_3$), which is consisting in a tube-like air-inducing, a ring-like mounted split (ring split) and/or in at least one lateral mounted little tube as $PH_3$-inducing (inducer), whereby the thickness of the split opening and/or of the opening of the little tube is maximum 1/25 of the diameter of the tube like air-inducing (inducer) and/or of the distance between the surface of an air guiding element and the inner side of the tube-like air-inducing (inducer) in the area of the $PH_3$-entrance.

It is well known that $PH_3$ is used since decades as a medium for pest control and for the prophylaxes in storage protection, especially concerning food (for man kind and animals).

As known, $PH_3$ is building with air a gaseous mixture which is easily flammable, whereby the ignition border lies at 1.8% $PH_3$-concentration. In the case this border will be exceeded, $PH_3$ is tending to self ignition.

Therefore numerous processes and devices have been proposed in order to have a thinning of $PH_3$ with air without danger.

Concerning the nearest art the German Offenlegungsschrift (published Patent Application) No 198 39 385 has to be named, which describes a effective process for the direct thinning of $PH_3$ with air whereby the mixing of air and $PH_3$ is carried out under or in present of water. Concerning the farer prior art the German Patent No. 691 29 456 T2 and the published International Patent Application WO93/25075 A1 are to be named.

SUMMARY OF THE INVENTION

The present invention proposes a device in form of a nozzle which device is as handy-device easily transportable and usable quickly at each wanted operation place.

The invention describes therefore a device which is universal and quickly usable.

The nozzle according to the invention was for example usable to mix within 1 hours 90000 liters air with $PH_3$ reaching a content of 10000 ppm $PH_3$ in the air.

Concerning he technological background it is to be stated that in the case of an ignition of a flammable mixture of air and $PH_3$ the reaction zone will be spread with super sonic velocity.

In the case a $PH_3$-stream will be guided in an air stream a self ignition will take place immediately, whereby little explosions will take place at the exit point of the $PH_3$; the little explosions effect immediately the so called resonance process due to the extension and following contraction effected by the explosion.

This phenomenon will be accompagnied by a whistling noise. Due to these explosions will be built a yellow-red fluid like mixture of phosphorous acid and poly-phosphines.

The equal phenomenon also have been detected by the dosage of $PH_3$ in an air stream using little bores whereby the bore holes always have been got dirty by polluting yellow acid whereby the bore wholes became closed when their diameter was between 1–2 mm.

This described negative phenomenons have been avoided according the German Offenlegungsschrift 198 39 385, because the water is preventing a resonance of the explosions.

The present invention is based on the surprising foundation of knowledge, that the producing of a laminar stream of $PH_3$ along the inner wall of a tube like air inducing will effect an optimum mixing of air and $PH_3$ without the danger of ignition until under the ignition border.

In the nozzle according to the present invention the effect of an ignition will be prevented by the fact, that the critical conditions will appear only in a very thin layer. The $PH_3$-layer will be immediately pulled with by a strong air stream and will be mixed into the air.

By this it is possible to produce mixtures, which contain up to 10000 ppm $PH_3$ without the danger of an ignition in the mixing zone. This can be controlled by the fact, that in the mixing zone no yellow phosphoric acid will be produced.

In the case a red-hot bar iron will be arranged exactly before the mixing point in the nozzle up to a concentration of 5000 ppm $PH_3$ a continuous ignition will not take place. Only as long as the ignition will take place, the whistling noise can be heard. In the practice for the attack with gas no mixtures with a higher $PH_3$-content as 2000 ppm will be used.

The nature of the present invention will now be described by the attached FIGS. 1–3, which show example like a preferred embodiment of the invention. The figures show a cut through the device according to the invention.

DETAILED DESCRIPTION

Figure 1:
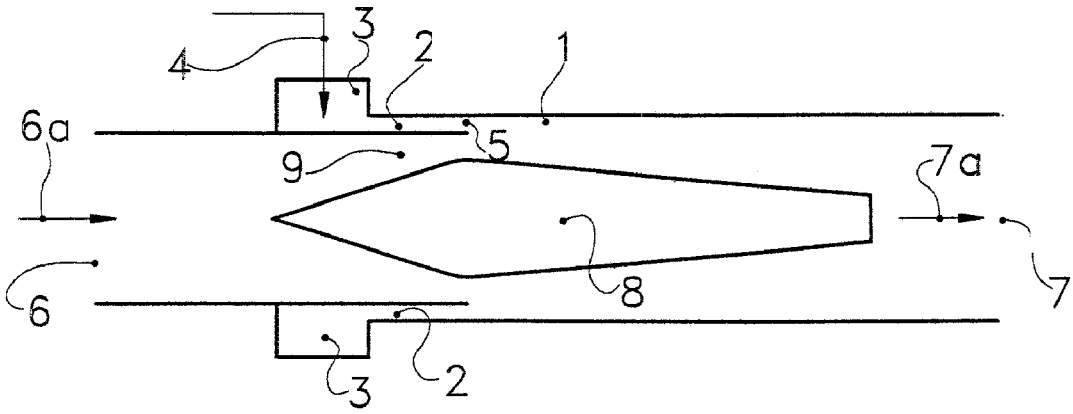
FIG. 1 shows a cross-sectional view of a nozzle.

The embodiment according FIG. 1 is consisting in a tube, open at both ends which carries the number 1. This tube has ring split 2 which has a ring like an adapter 3 through which in direction of the arrow 4 $PH_3$ is streaming with the consequence that at the entrance point 5 along the wall of the tube 1 is streaming. In the same time air is streaming with a very high velocity in the opening 6 of the tube 1 in direction of the arrow 6*a* whereby the stream of $PH_3$, which is already of laminar character, will build a still much thinner layer. The exit opening of the air-$PH_3$mixture carries the number 7, the stream direction of the mixture carries the number 7*a*.

In order to increase the pressure of the very quick streaming air on the laminar streaming $PH_3$ according to the preferred embodiment in the tube 1, there is arranged a bullet-like element 8, which head with an acute angle is showing in direction to the air entrance 6, whereby the thickest area of the bullet-like element 8 is arranged in the area of the ring split 2; 8 is a so called air guiding element.

The air which is guided through the tube has for example an overpressure of 350–440 mm water column and a velocity of 250–370 km/h.

The exit split 2 for the $PH_3$ shall have a diameter which will not exceed generally 0.2 mm. It have been tested nozzles with ring splits diameters of 0.6 mm; 0.3 mm and 0.1 mm, whereby the latter value have been found as an optimum. Due to the existence of the bullet-like element 8 it will be effected that the thickness of the air layer 9 over the $PH_3$-layer will exceed preferably not the value of 5 mm.

Figure 2:
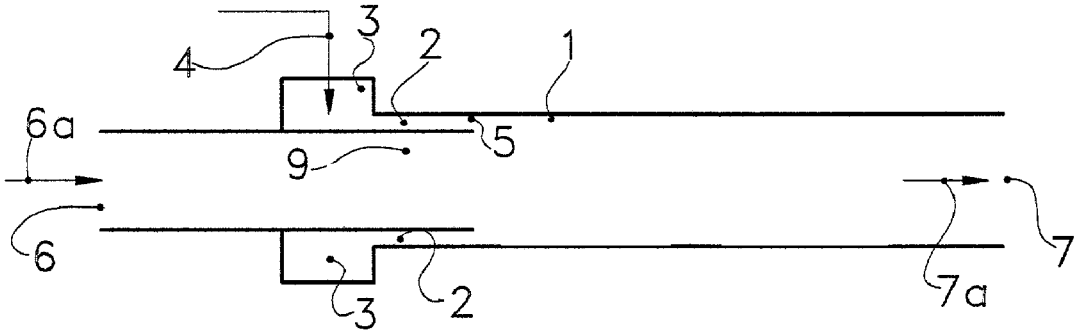
FIG. 2 shows a cross-sectional view of a nozzle with an air guiding element.

In the embodiment according FIG. 2 there is no bullet-like element present compared with FIG. 1.

The nozzle according to the present invention can be built easily out of some elements which can be quickly arranged together, whereby these elements are tightened by O-rings. The nozzle, which is consisting preferably out of stainless steel, can be also very easily disassembled in the different elements and can be easily controlled and easily cleaned, if necessary.

Figure 3:
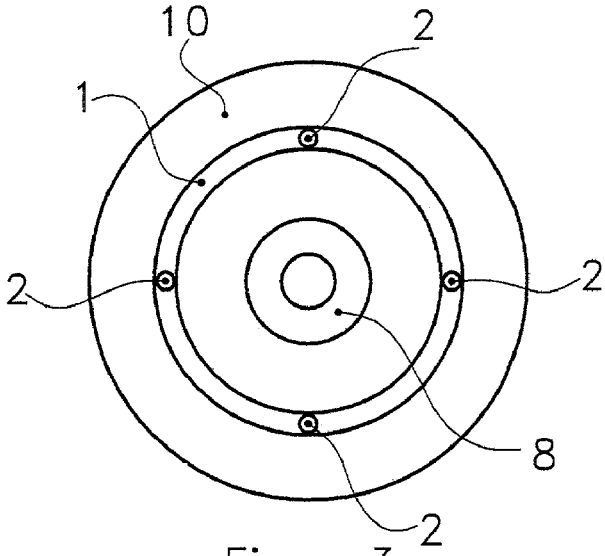
FIG. 3 shows a cross-sectional view of a nozzle with an air guiding element and tube elements.

According to a further embodiment which is shown in FIG. 3, the function of the $PH_3$ inducing is carried out by distinct little tubes, that means the ring-split is replaced partially or totally by the little tubes, the exits of them are situated parallel to the inner wall of the tube 1.

FIG. 3 shows a cut through the nozzle with this little tube element according to the present invention.

The tube, which is open at both sides carries the number 1, the little tubes carry the number 2, with number 8 the bullet-like air guiding element and with number 10 the ring-like adapter-element is named.

The invention claimed is:

1. A nozzle for mixing phosphine with a gas, the nozzle comprising:

an outer tubular body having an inner wall defining a mixing chamber, and an inlet for providing a laminar stream of phosphine in the form of a thin layer along the inner wall defining the mixing chamber;

an inner tubular body disposed concentrically within the outer tubular body and connected to the outer tubular body by a ring-like adapter, the inner tubular body being disposed so that an annular aperture is formed between a portion of an outer wall of the inner tubular body and a portion of the inner wall of the outer tubular body, the annular aperture being less than or equal to 0.2 mm and providing the phosphine an entrance to the mixing chamber, the inner tubular body including an inlet for providing a flow of the gas to the mixing chamber; and a bullet-like air guiding-element disposed concentrically within the inner tubular body so that the portion of the air guiding element having the greatest diameter is disposed in an area of the annular aperture.

2. The nozzle of claim 1, wherein the nozzle comprises of stainless steel.

3. The nozzle of claim 1, wherein the ring-like adapter is an O-ring.

4. The nozzle of claim 1, wherein the nozzle comprises of stainless steel.

5. The nozzle of claim 1, wherein the outer tubular body is a substantially cylindrical elongated body.

6. The nozzle of claim 1, wherein the inner tubular body is a substantially cylindrical elongated body.

* * * * *